US006848980B2

(12) United States Patent
Chen et al.

(10) Patent No.: US 6,848,980 B2
(45) Date of Patent: Feb. 1, 2005

(54) VIBRATION DAMPING IN A CARRIER HEAD

(75) Inventors: Hung Chih Chen, San Jose, CA (US); Steven M. Zuniga, Soquel, CA (US); Ramakrishna Cheboli, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 181 days.

(21) Appl. No.: 10/124,066

(22) Filed: Apr. 16, 2002

(65) Prior Publication Data

US 2003/0068966 A1 Apr. 10, 2003

Related U.S. Application Data

(63) Continuation-in-part of application No. 09/975,196, filed on Oct. 10, 2001.

(51) Int. Cl.[7] ..... B24B 7/00; B24B 9/00

(52) U.S. Cl. ..... 451/285; 451/41; 451/288; 451/290

(58) Field of Search ..... 451/41, 36, 59, 451/63, 285, 286, 287, 288, 289, 290, 397, 398

(56) References Cited

U.S. PATENT DOCUMENTS

| | | | | |
|---|---|---|---|---|
| 3,833,230 A | * | 9/1974 | Noll | 279/3 |
| 4,193,226 A | * | 3/1980 | Gill et al. | 451/276 |
| 4,217,766 A | * | 8/1980 | Suckow | |
| 4,373,991 A | | 2/1983 | Banks | |
| 4,519,168 A | | 5/1985 | Cesna | |
| 4,954,142 A | | 9/1990 | Carr et al. | |
| 5,081,795 A | | 1/1992 | Tanaka et al. | |
| 5,205,082 A | | 4/1993 | Shendon et al. | |
| 5,230,184 A | | 7/1993 | Bukhman | |

(List continued on next page.)

FOREIGN PATENT DOCUMENTS

| | | | |
|---|---|---|---|
| EP | 0 156 746 A1 | | 10/1985 |
| EP | 0 747 167 A2 | | 12/1996 |
| EP | 0 790 100 A1 | | 8/1997 |
| EP | 0 841 123 A1 | | 5/1998 |
| GB | 2 307 342 A | | 5/1997 |
| JP | 61-25768 | | 2/1986 |
| JP | 62-145830 | * | 6/1987 |
| JP | 2-243263 | | 9/1990 |
| WO | WO 99/62672 | | 12/1999 |

OTHER PUBLICATIONS

B. Holley and E. Mendel, "*Mounting Method for Single--Side Polishing*", Mar. 1979, IBM Technical Disclosure Bulletin, vol. 21, No. 10.

*Primary Examiner*—Timothy V. Eley
(74) *Attorney, Agent, or Firm*—Fish & Richardson

(57) ABSTRACT

A carrier head has a backing assembly with a substrate support surface, a housing connectable to a drive shaft to rotate with the drive shaft about a rotation axis, and a dampening material in a load path between the backing assembly and the housing. The dampening material reduces transmission of vibrations from the backing assembly to the housing.

13 Claims, 3 Drawing Sheets

U.S. PATENT DOCUMENTS 5,423,558 A 6/1995 Koeth et al.
5,423,716 A 6/1995 Strasbaugh
5,441,444 A 8/1995 Nakajima
5,443,416 A 8/1995 Volodarsky et al.
5,449,316 A 9/1995 Strasbaugh
5,584,746 A 12/1996 Tanaka et al.
5,584,751 A 12/1996 Kobayashi et al.
5,605,488 A 2/1997 Ohashi et al.
5,624,299 A 4/1997 Shendon
5,635,083 A 6/1997 Breivogel et al.
5,643,061 A 7/1997 Jackson et al.
5,679,064 A 10/1997 Nishi et al.
5,695,392 A 12/1997 Kim
5,716,264 A 2/1998 Kimura et al.
5,733,182 A 3/1998 Muramatsu et al.
5,738,568 A 4/1998 Jurjevic et al. ..... 451/41
5,759,918 A 6/1998 Hoshizaki et al.
5,795,215 A 8/1998 Guthrie et al.
5,851,140 A 12/1998 Barns et al.
5,899,798 A * 5/1999 Trojan et al. ..... 451/259
5,916,015 A * 6/1999 Natalicio ..... 451/288
5,916,412 A 6/1999 Nakashiba et al.
5,944,590 A 8/1999 Isobe et al.
5,993,302 A 11/1999 Chen et al.
6,007,252 A * 12/1999 Thelen et al. ..... 384/535
6,036,587 A 3/2000 Tolles et al.
6,044,818 A * 4/2000 Decuir
6,102,777 A 8/2000 Duescher et al. ..... 451/36
6,113,479 A * 9/2000 Sinclair et al. ..... 451/288
6,121,142 A * 9/2000 Crevasse et al. ..... 438/691
6,183,354 B1 2/2001 Zuniga et al.
6,190,238 B1 * 2/2001 Tanaka et al. ..... 451/41
6,196,904 B1 3/2001 Matsuo et al.

* cited by examiner

VIBRATION DAMPING IN A CARRIER HEAD

CROSS-REFERENCE TO RELATED APPLICATIONS

This application is a continuation-in-part application of and claims priority to U.S. application Ser. No. 09/975,196, filed on Oct. 10, 2001.

BACKGROUND

This invention relates generally to chemical mechanical polishing systems and processes.

Integrated circuits are typically formed on substrates, particularly silicon wafers, by the sequential deposition of conductive, semiconductive or insulative layers. As a series of layers are sequentially deposited and etched, the outer or uppermost surface of the substrate, becomes increasingly non-planar. This non-planar surface presents problems in the photolithographic steps of the integrated circuit fabrication process. Specifically, the photolithographic apparatus may not be able to focus the light image on the photoresist layer if the maximum height difference between the peaks and valleys of the non-planar surface exceeds the depth of focus of the apparatus. Therefore, there is a need to periodically planarize the substrate surface.

Chemical mechanical polishing (CMP) is one accepted method of planarization. Chemical mechanical polishing typically requires mechanically abrading the substrate in a slurry that contains a chemically reactive agent. During a typical polishing operation, the substrate is held against a rotating polishing pad by a carrier head. The carrier head may also rotate and move the substrate relative to the polishing pad. As a result of the motion between the carrier head and the polishing pad, abrasives, which may either be embedded in the polishing pad or contained in the polishing slurry, planarize the non-planar substrate surface by abrading the surface.

The polishing process generates vibrations that may reduce the quality of the planarization or damage the polishing apparatus. In addition, the vibrations can create nuisance noise.

SUMMARY

In one aspect, the invention is directed to a carrier head for positioning a substrate on a polishing surface. The carrier head has a backing assembly with a substrate support surface, a housing connectable to a drive shaft to rotate with the drive shaft about a rotation axis, and a damping material in a load path between the backing assembly and the housing. The damping material reduces transmission of vibrations from the backing assembly to the housing.

Implementations of the invention may include one or more of the following features. The carrier head may include a gimbal mechanism between the backing assembly and the housing that permits the backing assembly to gimbal relative to the housing. The backing assembly may include a rigid base, a flexible membrane secured to the rigid base to define a pressurizable chamber, or a compressible film on a bottom surface of the base. The housing may provide a bushing and the gimbal mechanism may includes a gimbal rod that extends into the bushing, the bushing may allow the gimbal rod to move vertically while preventing the gimbal rod from moving laterally.

The gimbal mechanism may include a top coupled to the housing, a bottom coupled to the backing assembly, and the damping material may separate the top from the bottom. The damping material may be mounted on at least one of the top and the bottom using a pressure sensitive adhesive. The damping material may form a generally annular body. The gimbal mechanism may include a substantially planar flexure ring that flexes in a direction perpendicular to the plane of the flexure ring to gimbal the backing assembly to the housing, and the damping material is mounted to the flexure ring.

The damping material may be located in the load path between the gimbal mechanism and the backing assembly. The gimbal mechanism may include a substantially planar flexure ring that flexes in a direction perpendicular to the plane of the flexure ring to gimbal the backing assembly to the housing, and the damping material may abut the flexure ring. The flexure ring may include a plurality of projections or a flange that extends into the damping material.

The damping material may be viscoelastic. The damping material may not rebound to its original shape when subjected to a deformation. For example, the damping material may rebound by less than six percent of the deformation.

In another aspect, the invention is directed to a chemical mechanical polishing apparatus that includes the carrier head.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
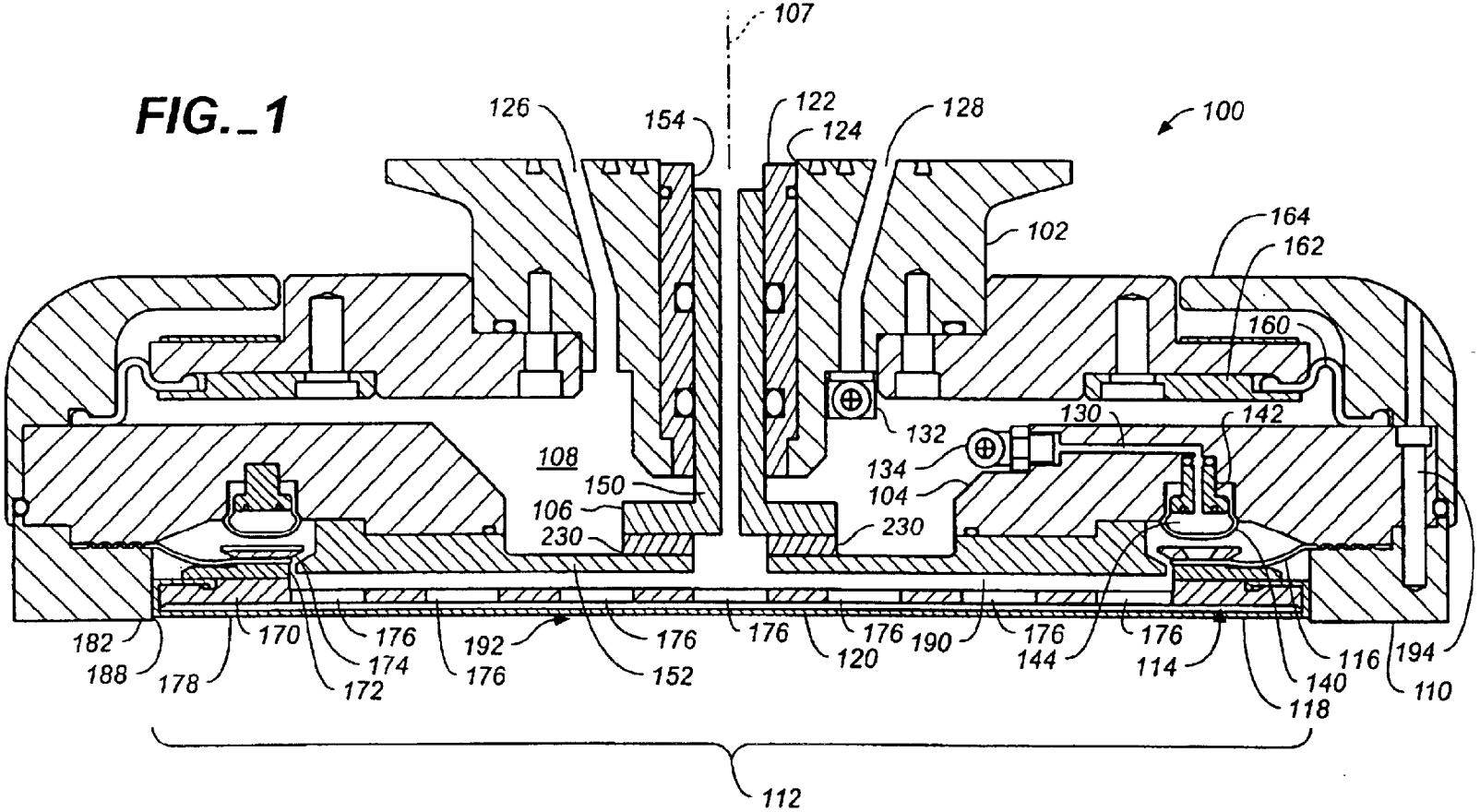
FIG. 1 is a cross-sectional view of a carrier head.

Referring to FIG. 1, a chemical mechanical polishing (CMP) apparatus includes a carrier head 100 to hold a substrate during polishing. A description of a suitable CMP apparatus maybe found in U.S. Pat. No. 5,738,574, the entire disclosure of which is hereby incorporated by reference.

During polishing, the carrier head 100 presses a substrate 10 against a polishing pad with a pre-determined loading force. At the same time, a motor rotates the carrier head to rotate the substrate. In addition, a slider can oscillate the carrier head 100 and the substrate laterally on the surface of the polishing pad.

The carrier head 100 includes a vibration damping material to significantly reduce the transfer of vibrational energy between adjacent parts, thereby reducing or preventing vibration during polishing. Generally, the damping material has significantly better vibration damping characteristics than both adjacent parts of the polishing apparatus, which are typically made from stiff materials, e.g., metals. The damping material can be a visco-elastomer with little or no memory so as to provide good vibration damping characteristics, such as the commercially available, isolation damping material, C-1002, which is manufactured by E-A-R specialty composites of 7911 Zionesville Rd, Indianapolis, Ind. 46268.

As shown in FIG. 1, the carrier head 100 includes a housing 102, a base 104, a gimbal mechanism 106, a retaining ring 110, and a substrate backing assembly 112 (which can also be considered to include the base 104). The housing 102 is substantially cylindrical and can be connected to a drive shaft using a set of bolts (not shown). The drive shaft rotates the housing about an axis 107. A passage 126 extends through the housing 102 for pneumatic control of the carrier head, as will be described below. The housing 102 has a cylindrical bushing 122 fitted into a vertical bore 124 that runs vertically through the housing.

The gimbal mechanism 106 includes a gimbal rod 150 and a flexure ring 152. The gimbal rod 150 fits into the bushing 122 so that the rod 150 is free to move vertically within the bore while the bushing 122 prevents lateral motion of the gimbal rod 150. The flexure ring 152 is attached to a flange 220 at the lower end of the gimbal rod 150 by a damping material 230 to prevent or reduce the transmission of vibration energy from the flexure ring 152 to the housing 102 through the gimbal ring 220. The damping material 230 is 0.06 inches thick. Pressure sensitive adhesive (not shown) adheres the damping material 230 to both the housing 102 and the flexure ring 152.

The flexure ring 152, which is a generally planar annular ring, is attached to the generally ring-shaped base 104. The flexure ring 152 flexes in a direction perpendicular to the plane of the flexure ring 152, thereby gimballing the base 104 relative to the gimbal rod 150 and the housing 102. The gimbal mechanism also allows the base 104 to move up and down by allowing the gimbal rod 150 to move vertically within the bore 122, while preventing any lateral motion of the base. The damping material 230 reduces or prevents the transmission of vibrational energy from the base 104 into the housing 102 through the gimbal mechanism 106.

An outer clamp ring 164 clamps an outer edge of a rolling diaphragm 160 to the base 104, whereas an inner clamp ring 162 clamps an inner edge of the rolling diaphragm 160 to the housing. Thus, the rolling diaphragm 160 seals a loading chamber 108 formed by the housing 102, the gimbal rod 106, the gimbal ring 220, the damping material 230, the flexure ring 152, and the base 104, leaving an opening 126 into the chamber 108. The opening 126 is connected to a pump (not shown), which lowers or raises the base by pumping fluid, e.g., air, into or out of the chamber 108, respectively. By controlling the pressure of the fluid pumped into the loading chamber 108, the pump can press down the base towards the polishing surface with a desired loading force.

The retaining ring 110 is a generally annular ring secured to the base 104. During polishing, fluid is pumped into the loading chamber 108, thereby generating pressure in the chamber 108. The generated pressure exerts a downward force on the base 104, which in turn exerts a downward force on the retaining ring 110. The downward force presses the retaining ring 110 against the polishing pad 32.

The substrate backing assembly 112 includes a flexure diaphragm 116, which is clamped between the retaining ring 110 and the base 104. An inner edge of the flexure diaphragm 116 is clamped between an annular lower clamp 172 and an annular upper clamp 174 of a support structure 114. A support plate 170 of the support structure 114 is attached to the lower clamp 172. The flexure diaphragm allows some vertical motion of the support plate 170 relative to the base 104. The support plate 170 is a generally disk-shaped rigid member with a plurality of apertures 176 through it (only one is labeled in FIG. 2). The support plate 170 has a downwardly projecting lip 178 at its outer edge.

A flexible membrane 118 extends around the lip 178 of the support plate 170 and is clamped between the support plate 170 and the lower clamp 172, to form a generally disk shaped lower surface 120. The flexible membrane is formed from a flexible and elastic material, such as chloroprene or ethylene propylene rubber. Alternatively, the flexure diaphragm and the flexible membrane can be combined in a single-piece membrane. The sealed volume between the flexible membrane 118, support structure 114, flexure diaphragm 116, base 104, and flexure ring 152 defines a chamber 190 whose only opening 250 runs through the gimbal rod 150. A pump (not shown) is connected to the opening 250 to control the pressure in the chamber 190 by pumping fluid, into the chamber through the opening 250, thereby controlling the downward pressure of the membrane lower surface 120 on the substrate 10.

Figure 2A:
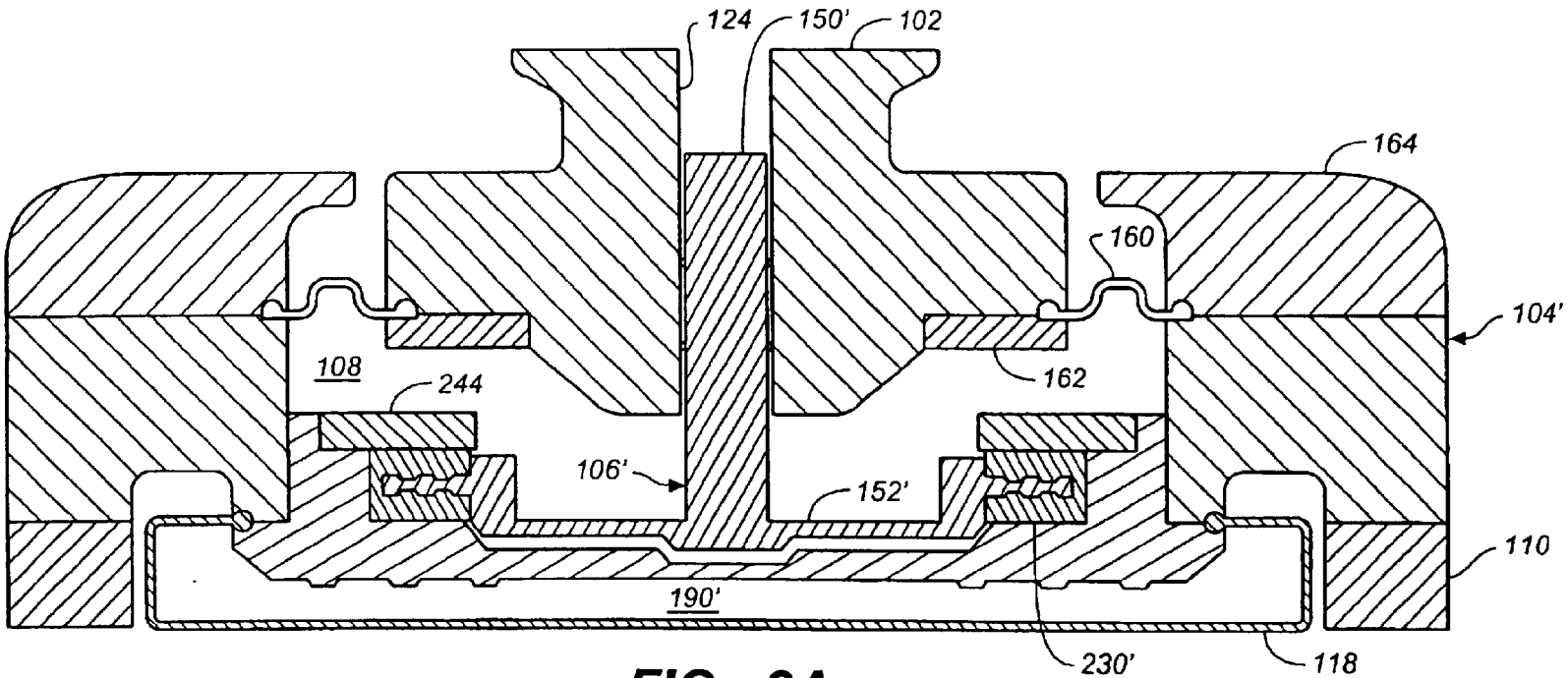
FIG. 2A is a cross-sectional view of an alternative implementation of a carrier head.
Figure 2B:
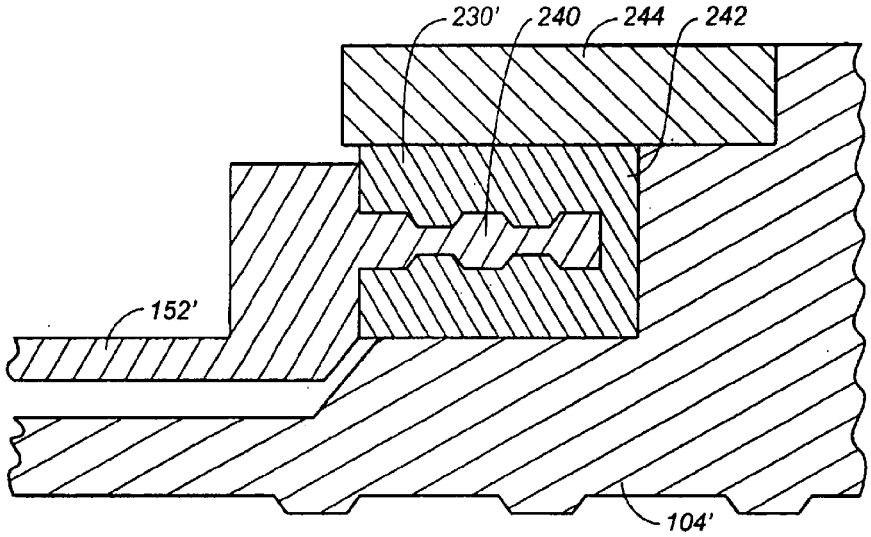
FIG. 2B is an expanded view of the dampening material from the carrier head of FIG. 2A.

Referring to FIGS. 2A and 2B, in another implementation, the gimbal rod 150' and flexure ring 152' are formed as a unitary single part. In addition, this implementation does not include a support structure 114 or a flexure 116. Rather, the flexible membrane is connected directly to the base 104'.

In this implementation, the damping material 230' is placed between the flexure ring 152' and the base 104'. Specifically, the flexure ring 152' includes a plurality of knobbed projections 240 that extend radially outward into slots 242 in the base 104'. The slots 242 are filled with the viscoelastic dampening material 230', and the top of the slot is closed with an annular ring 244 that is secured to the rest of the base 104'. For example, the damping material can include a lower layer between the projections and the base thus, less vibrational energy is transmitted from the base 104' to the gimbal 106'.

Figure 2C:
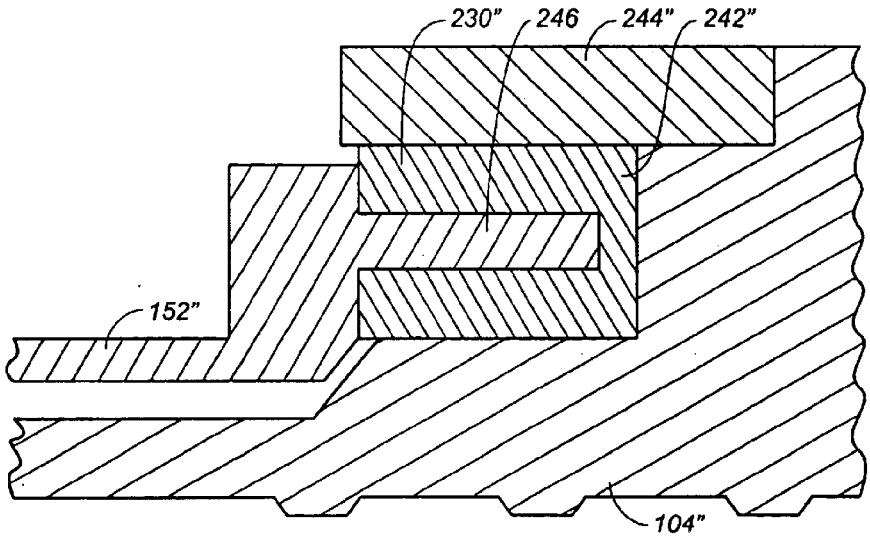
FIG. 2C is an alternative expanded view of the dampening material from the carrier head of FIG. 2A.

Alternatively, as shown in FIG. 2C, rather than individual projections 240, the flexure ring 152" can include an annular flange 246 that extends radially outwardly and is trapped in the viscoelastic damping material 230" between the base 104" and the annular ring 244".

A number of implementations of the invention have been described. Nevertheless, it will be understood that various modifications may be made without departing from the spirit and scope of the invention. For example, the damping material may be used with other kinds of polishing apparatus known to persons skilled in the art. For example, the polishing system can use a linear belt-type pad rather than a rotating pad. The polishing apparatus that can use either a standard non-abrasive polishing pad, or a fixed abrasive pad, and can use a slurry with or without abrasive particles. In addition, the damping material can be used in other types of carrier heads. The carrier head can use a rigid support structure or base that holds the substrate instead of a flexible membrane. A compressible carrier film may be located on the bottom of the rigid support structure. The retaining ring need not contact the polishing pad.

The vibration damping material may also be used in other locations in the carrier head, such as between the retaining ring and the base, or within the base itself, that are in the load path between the flexible membrane and the housing. Other materials with suitable damping properties may be used to damp vibrations, so long as they significantly reduce or prevent the transmission of vibrational energy from one end of the material to another. In general, the material can be viscoelastic material. In addition, a damping material can be chosen which does not rebound to its original shape when deformed. Specifically, when subjected to a deformation, the damping material should rebound by less than ten percent of the deformation, although a rebound of less than six percent of the deformation is preferred. For instance, the damping material may be any isodamp C-1000 series isolation damping material, manufactured by E-A-R specialty composites, a visco-elastomer, a soft-plastic, or any other material that has better vibration damping properties than materials immediately adjacent to the damping material.

The thickness of the damping material may be varied to provide optimum results in operating conditions that have different loading, carrier head rotation speed, polishing pad rotation speed, damping material, and so on. A thicker damping material may be used to improve the vibration damping, although poor control of the relative motion of the substrate and the polishing pad may result from a damping material that is too thick. A thinner damping material may also be used, although if the damping material is too thin, it may not sufficiently reduce or prevent the transmission of vibrational energy.

Accordingly, other embodiments are within the scope of the following claims.

What is claimed is:

1. A carrier head for positioning a substrate on a polishing surface, comprising:

a backing assembly with a substrate support surface;

a housing connectable to a drive shaft to rotate with the drive shaft about a rotation axis;

a gimbal mechanism between the backing assembly and the housing that permits the backing assembly to gimbal relative to the housing: and a damping material that is positioned in a load path between the gimbal mechanism and the backing assembly to reduce transmission of vibrations from the backing assembly to the housing, where the gimbal mechanism and the backing assembly are separated by the damping material and are not in direct contact.

2. The carrier head of claim 1, wherein the backing assembly includes a rigid base.

3. The carrier head of claim 2, wherein the backing assembly includes a flexible membrane secured to the rigid base to define a pressurizable chamber.

4. The carrier head of claim 2, wherein the backing assembly includes a compressible film on a bottom surface of the base.

5. The carrier head of claim 1, wherein the gimbal mechanism includes a substantially planar flexure ring that flexes in a direction perpendicular to a plane of the flexure ring to gimbal the backing assembly to the housing, and the damping material is mounted to the flexure ring.

6. The carrier head of claim 1, wherein the gimbal mechanism includes a substantially planar flexure ring that flexes in a direction perpendicular to a plane of the flexure ring to gimbal the backing assembly to the housing, and the damping material abuts the flexure ring.

7. The carrier head of claim 6, wherein the flexure ring includes a plurality of projections that extend into the damping material.

8. The carrier head of claim 6, wherein the flexure ring includes a flange that extends into the damping material.

9. The carrier head of claim 1, wherein the damping material is viscoelastic.

10. The carrier head of claim 1, wherein the damping material does not rebound to its original shape when subjected to a deformation.

11. The carrier head of claim 10, wherein the damping material rebounds by less than six percent of the deformation.

12. A chemical mechanical polishing apparatus comprising:

a polishing pad; and a carrier head for positioning a substrate on a polishing surface, the carrier head including:

a backing assembly with a substrate support surface;

a housing connectable to a drive shaft to rotate with the drive shaft about a rotation axis;

a gimbal mechanism between the backing assembly and the housing that permits the backing assembly to gimbal relative to the housing; and a damping material in a load path between the backing assembly and the gimbal mechanism to reduce transmission of vibrations from the backing assembly to the housing, where the gimbal mechanism and the backing assembly are separated by the damping material and are not in direct contact.

13. The apparatus of claim 12, wherein the damping material is a viscoelastic material.

* * * * *